US009796555B2

(12) United States Patent
Furuta et al.

(10) Patent No.: US 9,796,555 B2
(45) Date of Patent: Oct. 24, 2017

(54) IMAGE FORMING APPARATUS AND IMAGE FORMATION SYSTEM

(71) Applicant: Konica Minolta, Inc., Chiyoda-ku, Tokyo (JP)

(72) Inventors: Tatsuya Furuta, Tokyo (JP); Tomohiro Kawasaki, Kanagawa (JP); Shota Sakurai, Tokyo (JP); Tetsuya Ishikawa, Kanagawa (JP); Natsuko Kawai, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 52 days.

(21) Appl. No.: 15/057,471

(22) Filed: Mar. 1, 2016

(65) Prior Publication Data

US 2016/0257521 A1 Sep. 8, 2016

(30) Foreign Application Priority Data

Mar. 4, 2015 (JP) ..... 2015-042315

(51) Int. Cl.

*B65H 37/00* (2006.01)
*B65H 18/10* (2006.01)
*G03G 15/00* (2006.01)

(52) U.S. Cl.

CPC ..... *B65H 37/00* (2013.01); *B65H 18/103* (2013.01); *G03G 15/652* (2013.01); *G03G 15/6529* (2013.01); *G03G 15/6558* (2013.01); *G03G 15/6591* (2013.01); *B65H 2301/5112* (2013.01); *B65H 2701/1315* (2013.01); *B65H 2701/1842* (2013.01); *B65H 2801/06* (2013.01); *G03G 2215/00523* (2013.01)

(58) Field of Classification Search

USPC ..... 156/385, 535, 538, 580, 581
See application file for complete search history.

(56) References Cited

U.S. PATENT DOCUMENTS 6,663,740 B2 * 12/2003 Yamasaki ..... B32B 38/0004 156/248
6,717,286 B2 * 4/2004 Tsuchiya et al. ..... B42C 1/12 270/52.18
6,776,090 B2 * 8/2004 Takenaka et al. ... H05K 3/1225 101/123
7,584,949 B2 * 9/2009 Kaneko et al. ..... B42C 11/04 270/58.05
7,664,422 B2 * 2/2010 Shida et al. ..... B65H 37/00 118/258
7,759,035 B2 * 7/2010 Ninomiya ..... G03G 9/0812 430/108.1

(Continued)

FOREIGN PATENT DOCUMENTS

JP H06230727 A 8/1994
JP 11123812 A * 5/1999 ..... B41F 27/1268

OTHER PUBLICATIONS

English Abstract of JP 11-123812 (Jun. 11, 2017).*

*Primary Examiner* — Sing P Chan
(74) *Attorney, Agent, or Firm* — Cantor Colburn LLP

(57) ABSTRACT

An image forming apparatus includes: an image forming section configured to form a toner image on a sheet having a paste component; and an end pressing section provided on an upstream side of the image forming section in a sheet conveyance direction, and configured to exert a pressure on an end portion of the sheet while moving from a center toward an end of the sheet in a sheet width direction orthogonal to the sheet conveyance direction.

17 Claims, 12 Drawing Sheets

(56) References Cited

U.S. PATENT DOCUMENTS 7,789,382 B2 * 9/2010 Fukushima ..... B42C 9/0025 270/58.07
7,866,643 B2 * 1/2011 Nakamichi et al. .. B42C 9/0037 270/20.1
8,475,106 B2 * 7/2013 Hata ..... B26F 1/0092 281/21.1
9,346,648 B2 * 5/2016 Osada ..... B65H 37/04
9,409,741 B2 * 8/2016 Osada ..... B65H 37/04
2002/0089111 A1 * 7/2002 Tsuchiya et al. ..... B42C 1/12 270/58.08
2002/0162628 A1 * 11/2002 Yamasaki ..... B32B 38/0004 156/701
2002/0178942 A1 * 12/2002 Takenaka et al. ... H05K 3/1225 101/127.1
2005/0063953 A1 * 3/2005 Falck-Pedersen ..... C12N 15/86 424/93.2
2007/0035081 A1 * 2/2007 Kaneko et al. ..... B42C 11/04 270/58.09
2007/0240640 A1 * 10/2007 Shida et al. ..... B65H 37/00 118/258
2008/0038092 A1 * 2/2008 Nakamichi et al. .. B42C 9/0037 412/14
2008/0061501 A1 * 3/2008 Tamura et al. ..... B65H 29/12 271/303
2008/0158616 A1 * 7/2008 Kudo ..... H04N 1/00567 358/424
2008/0219802 A1 * 9/2008 Hata ..... B26F 1/0092 412/12
2008/0272532 A1 * 11/2008 Fukushima ..... B42C 9/0025 270/58.08
2015/0174941 A1 * 6/2015 Osada ..... B42C 9/0081 412/37
2015/0175379 A1 * 6/2015 Osada ..... B65H 37/04 270/58.08
2015/0210503 A1 * 7/2015 Osada ..... B65H 37/04 270/1.01
2016/0313687 A1 * 10/2016 Osada ..... G03G 15/6541
2016/0339731 A1 * 11/2016 Taguchi ..... B42C 19/02

* cited by examiner

IMAGE FORMING APPARATUS AND IMAGE FORMATION SYSTEM

CROSS REFERENCE TO RELATED APPLICATIONS

This application is entitled to and claims the benefit of Japanese Patent Application No. 2015-042315, filed on Mar. 4, 2015, the disclosure of which including the specification, drawings and abstract is incorporated herein by reference in its entirety.

BACKGROUND OF THE INVENTION

1. Field of the Invention

The present invention relates to an electrophotographic image forming apparatus and an image formation system.

2. Description of Related Art

In general, an electrophotographic image forming apparatus (such as a printer, a copy machine, and a fax machine) is configured to irradiate (expose) a charged photoconductor with (to) laser light based on image data to form an electrostatic latent image on the surface of the photoconductor. The electrostatic latent image is then visualized by supplying toner from a developing device to the photoconductor (image carrier) on which the electrostatic latent image is formed, whereby a toner image is formed. Further, the toner image is directly or indirectly transferred to the sheet, and thereafter fixed through heating and pressing at a fixing nip of a heating member (for example, a fixing roller) and a pressing member (for example, a pressure roller), thereby forming an image on the sheet.

Examples of the sheets used in the above-mentioned image formation system include, in addition to common sheets composed only of paper, a sheet called label sheet which contains paste (adhesive agent) for pasting. Examples of such a label sheet include, in addition to short sheets such as A4-sheets, long sheets of several hundred meters long in one roll (hereinafter referred to as "label roll sheet").

Conventionally, an image formation system in which a sheet feeding apparatus configured to feed a long sheet is connected on a preceding side of the above-mentioned image forming apparatus, and a winding apparatus configured to wind up the long sheet on which an image is formed by the image forming apparatus is connected on a succeeding side of the above-mentioned image forming apparatus has been practically used as a system suitable for a long sheet such as the label roll sheet.

When a sheet containing paste such as the label sheet is used in the above-mentioned image formation system, paste (adhesive agent) of a sheet end portion may be exuded and attached to a roller or a belt during a pressing operation at a secondary transfer section and a fixing section of the image forming apparatus, and a transfer cleaning section, a secondary transfer roller, or a belt may be smeared, thus causing abnormal abrasion and image defects during a cleaning operation and the like.

Japanese Patent Application Laid-Open No. 6-230727 discloses a method in which paste of a sheet end portion is removed at the time of manufacturing label sheets. Japanese Patent Application Laid-Open No. 6-230727 discloses a method in which both end portions of a label sheet are pressed with a pair of upper and lower press rollers to put out adhesive agent (paste), and thereafter, the part on the end portion side relative to an appropriate position of the pressed portion at the both end portions of the label sheet is disconnected and removed using a pair of upper and lower slitters.

In the conventional method of removing adhesive agent disclosed in Japanese Patent Application Laid-Open No. 6-230727, both end portions of a label sheet are simply pressed with the pressing rollers, and as such adhesive agent may not sufficiently protruded from the sheet end portion. In the above-mentioned method of removing adhesive agent, the sheet end portions are disconnected regardless of whether the adhesive agent is sufficiently protruded, and the adhesive agent is removed together with the corresponding part of the sheet. However, in this case, the disconnected sheet end portion becomes wastes, and as a result operations or components for the wastes are required to be provided. In addition, in the case where change of the sheet area due to disconnection is not allowed, such a method cannot be employed as a matter of course.

SUMMARY OF THE INVENTION

An object of the present invention is to provide an image forming apparatus and an image formation system in which, when a sheet containing paste such as a label sheet is used, the paste at an end portion of the sheet can be sufficiently removed.

To achieve the above-mentioned object, an image forming apparatus includes: an image forming section configured to form a toner image on a sheet having a paste component; and an end pressing section provided on an upstream side of the image forming section in a sheet conveyance direction, and configured to exert a pressure on an end portion of the sheet while moving from a center toward an end of the sheet in a sheet width direction orthogonal to the sheet conveyance direction.

To achieve the above-mentioned object, an image formation system comprising: a sheet feeding apparatus configured to feed a label roll sheet having a paste component; the above-mentioned image forming apparatus; and a winding apparatus configured to wind up the label roll sheet on which an image is formed by the image forming apparatus.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

In the following, the present embodiment is described in detail with reference to the drawings.

Figure 1:
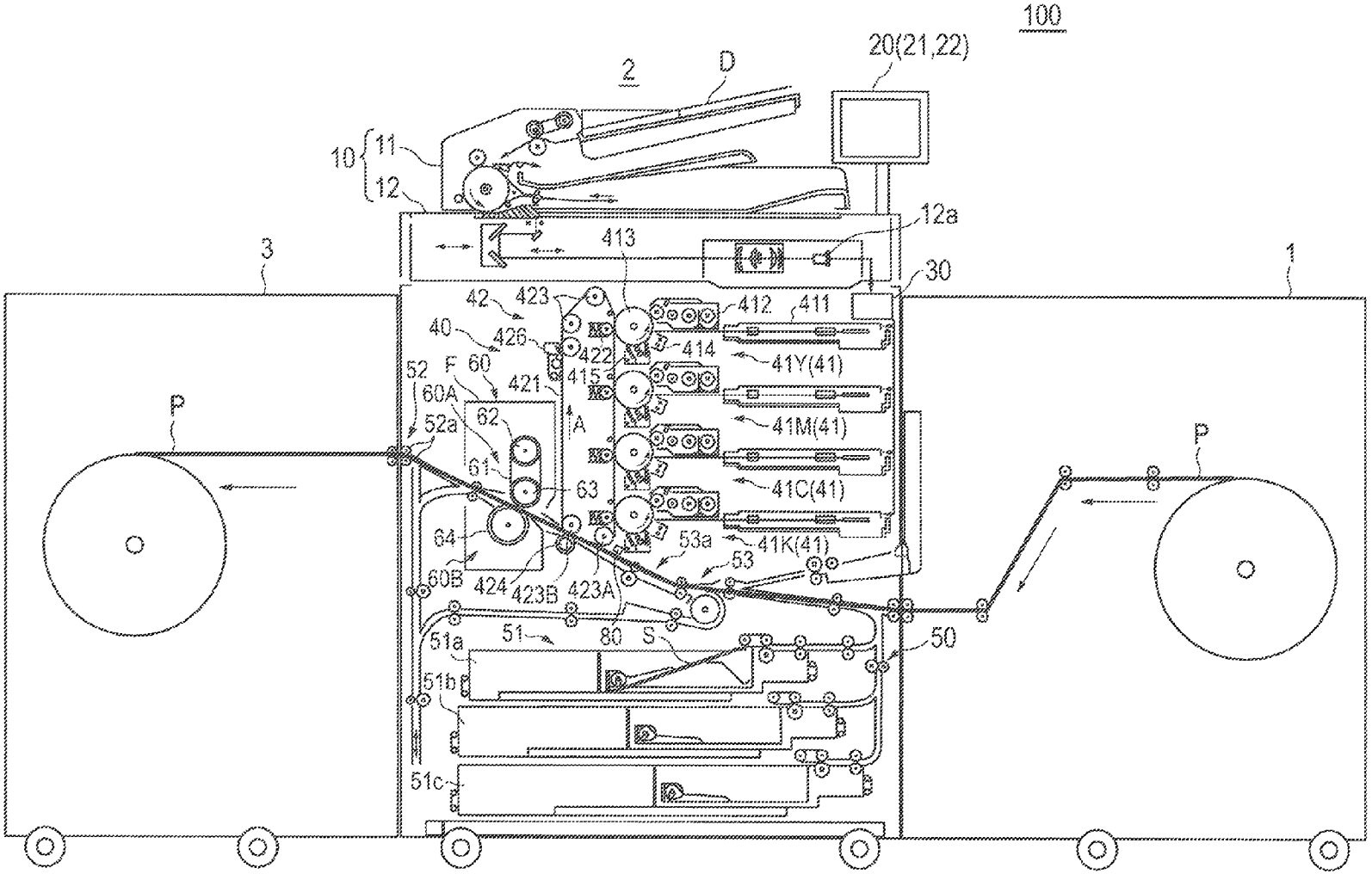
FIG. 1 schematically illustrates a general configuration of an image formation system including an image forming apparatus according to an embodiment of the present invention.
Figure 2:
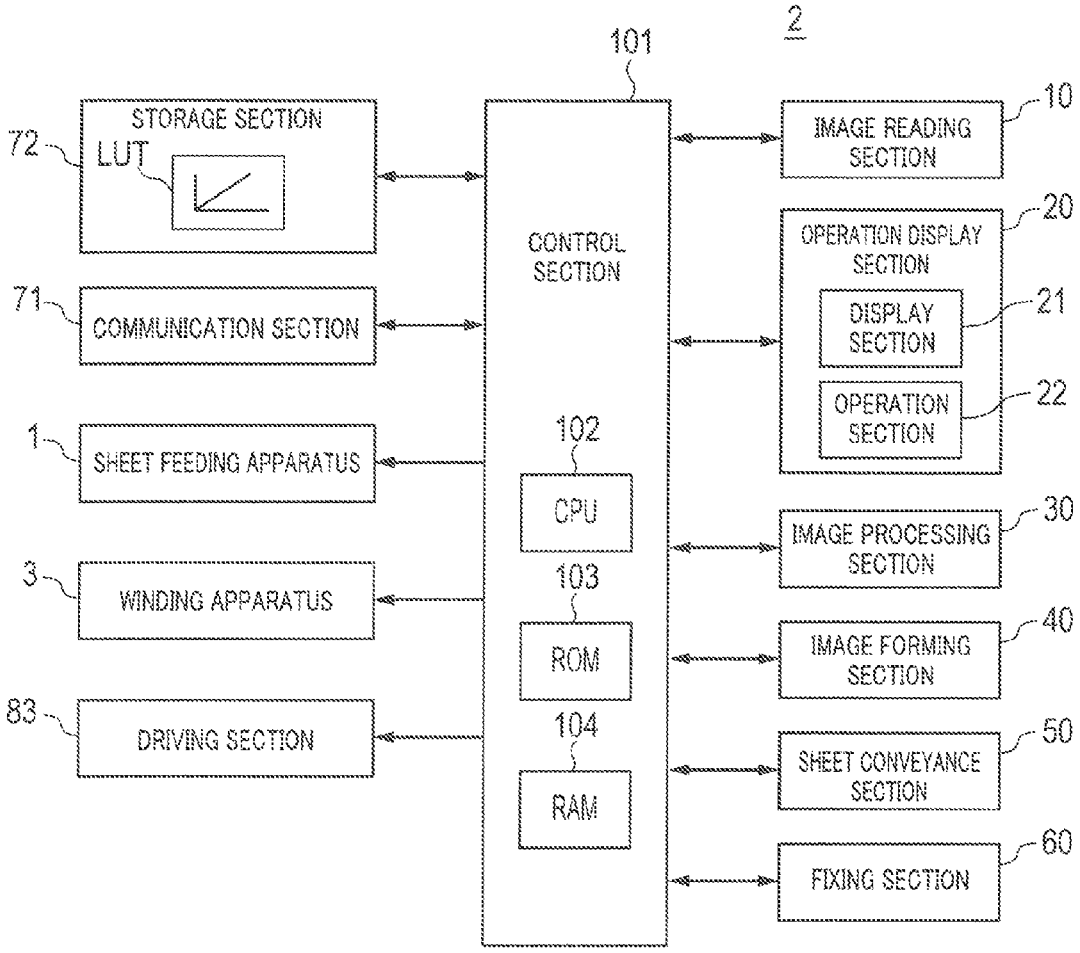
FIG. 2 illustrates a configuration of a principal part of a control system of the image forming apparatus of FIG. 1.

FIG. 1 schematically illustrates a general configuration of image forming system 100 according to an embodiment of the present invention. FIG. 2 illustrates a configuration of a principal part of a control system of image forming apparatus 2 of image formation system 100 according to the present embodiment. Image formation system 100 is a system that uses long sheet P indicated with the heavy line in FIG. 1, or sheets (also referred to as "cut paper") S cut into a predetermined paper size as a recording medium, and forms an image on long sheet P or sheet S. Here, long sheet P is a sheet which has a length a greater than the width of the main body of image forming apparatus 2 in the conveyance direction, for example. In the present embodiment, a label roll sheet in which a release sheet whose rear surface (the surface for releasing agent) is covered with paste is attached on a base material on which releasing agent is applied is used as long sheet P. After an image is formed on its front surface, the release sheet is peeled off from the base material and stuck on an object when in use. In the following description, long sheet P is referred to as label roll sheet P.

As illustrated in FIG. 1, in image forming system 100, sheet feeding apparatus 1, image forming apparatus 2 and winding apparatus 3 are connected to each other from the upstream side in the conveyance direction of label roll sheet P (hereinafter referred to also as "sheet conveyance direction"). Sheet feeding apparatus 1 and winding apparatus 3 are used when an image is formed on label roll sheet P.

Sheet feeding apparatus 1 is an apparatus that feeds label roll sheet P to image forming apparatus 2. As illustrated in FIG. 1, in the housing of sheet feeding apparatus 1, label roll sheet P in a roll form is wound around a support shaft and is rotatably held. Sheet feeding apparatus 1 conveys, via a plurality of conveyance roller pairs (for example, delivery rollers, sheet feed rollers and the like), label roll sheet P wound around the support shaft to image forming apparatus 2 at a constant speed. The sheet feeding operation of sheet feeding apparatus 1 is controlled by control section 101 of image forming apparatus 2.

It is to be noted that, in sheet feeding apparatus 1, label roll sheet P may not be held in a roll shape, and a plurality of label roll sheets P of a predetermined size (for example, 210 [mm]×1200 [mm]) may be held.

Image forming apparatus 2 is a color-image forming apparatus of an intermediate transfer system using electrophotographic process technology. Specifically, image forming apparatus 2 primary-transfers toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 2 secondary-transfers the resultant image to label roll sheet P fed from sheet feeding apparatus 1 or sheet S sent from sheet feed tray units 51*a* to 51*c*, to thereby form an image.

A longitudinal tandem system is adopted for image forming apparatus 2. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

As illustrated in FIG. 2, image forming apparatus 2 includes image reading section 10, operation display section 20, image processing section 30, image forming section 40, sheet conveyance section 50, fixing section 60, communication section 71, storage section 72, driving section 83, and control section 101.

Control section 101 includes central processing unit (CPU) 102, read only memory (ROM) 103, random access memory (RAM) 104 and the like. CPU 102 reads out a program corresponding to processing details from ROM 103, loads the program in RAM 104, and performs a centralized control of operations of the blocks and the like of image forming apparatus 2 in conjunction with the loaded program. At this time, CPU 101 refers to various kinds of data stored in storage section 72. Storage section 72 is composed of, for example, a non-volatile semiconductor memory (so-called flash memory) or a hard disk drive.

Control section 101 transmits and receives various data to and from an external apparatus (for example, a personal computer) connected to a communication network such as a local area network (LAN) or a wide area network (WAN), through communication section 71. Control section 101 receives, for example, image data transmitted from the external apparatus, and performs control to form an image on label roll paper P or sheet S on the basis of the image data (input image data). Communication section 71 is composed of, for example, a communication control card such as a LAN card. When label roll sheet P is used, control section 101 operates driving section 83 to remove the paste contained at end portions of label roll sheet P.

Image reading section 10 includes auto document feeder (ADF) 11, document image scanning device 12 (scanner), and the like. Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) with a touch panel, and functions as display section 21 and operation section 22. Display section 21 displays various operation screens, image conditions, operating statuses of functions, and the like in accordance with display control signals received from control section 101. Operation section 22 includes various operation keys such as numeric keys and a start key, receives various input operations performed by a user, and outputs operation signals to control section 101.

Image processing section 30 includes a circuit that performs a digital image process suited to initial settings or user settings on the input image data, and the like. For example, image processing section 30 performs tone correction on the basis of tone correction data (tone correction table), under the control of control section 101. In addition to the tone correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41Y, 41M, 41C, and 41K that form images of colored toners of a Y component, an M component, a C component, and a K component on the basis of the input image data; intermediate transfer unit 42; and the like.

Image forming units 41Y, 41M, 41C, and 41K for the Y component, the M component, the C component, and the K component have similar configurations. For ease of illustration and description, common elements are denoted by the same reference signs. Only when elements need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Image forming unit 41 includes exposing device 411, developing device 412, photoconductor drum 413, charging device 414, drum cleaning device 415 and the like.

Photoconductor drums 413 are, for example, negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) which is made of aluminum and has a diameter of 80 [mm]. The charge generation layer is made of an organic semiconductor in which a charge generating material (for example, phthalocyanine pigment) is dispersed in a resin binder (for example, polycarbonate), and generates a pair of positive charge and negative charge through light exposure by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Control section 101 controls a driving current supplied to a driving motor (not shown in the drawings) that rotates photoconductor drums 413, whereby photoconductor drums 413 is rotated at a constant circumferential speed.

Charging device 414 evenly negatively charges the surface of photoconductor drum 413. Exposure device 411 is composed of, for example, a semiconductor laser, and configured to irradiate photoconductor drum 413 with laser light corresponding to the image of each color component. The positive charge is generated in the charge generation layer of photoconductor drum 413 and is transported to the surface of the charge transport layer, whereby the surface charge (negative charge) of photoconductor drum 413 is neutralized. An electrostatic latent image of each color component is formed on the surface of photoconductor drum 413 by the potential difference from its surroundings.

Developing device 412 is a developing device of a two-component developing type, and attaches toners of respective color components to the surface of photoconductor drums 413, and visualizes the electrostatic latent image to form a toner image.

Drum cleaning device 415 includes a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426 and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Preferably, for example, roller 423A disposed on the downstream side in the belt travelling direction relative to primary transfer rollers 422 for K-component is a driving roller. With this configuration, the travelling speed of the belt at a primary transfer section can be easily maintained at a constant speed. When driving roller 423A rotates, intermediate transfer belt 421 travels in arrow A direction at a constant speed.

Intermediate transfer belt 421 is a belt having conductivity and elasticity which includes on the surface thereof a high resistance layer having a volume resistivity of 8 to 11

[log Ω·cm]. Intermediate transfer belt 421 is rotationally driven by a control signal from control section 101. It is to be noted that the material, thickness and hardness of intermediate transfer belt 421 are not limited as long as intermediate transfer belt 421 has conductivity and elasticity.

Primary transfer rollers 422 are disposed to face photoconductor drums 413 of respective color components, on the inner periphery side of intermediate transfer belt 421. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face backup roller 423B disposed on the downstream side in the belt travelling direction relative to driving roller 423A, on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to label roll sheet P or sheet S is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when label roll sheet P or sheet S passes through the secondary transfer nip, the toner image on intermediate transfer belt 421 is secondary-transferred to label roll sheet P or sheet S. To be more specific, a secondary transfer bias is applied to secondary transfer roller 424, and an electric charge of the polarity opposite to the polarity of the toner is applied to the rear side (the side that makes contact with secondary transfer roller 424) of label roll sheet P or sheet S, whereby the toner image is electrostatically transferred to label roll sheet P or sheet S. Label roll sheet P or sheet S on which the toner images have been transferred is conveyed toward fixing section 60.

Belt cleaning device 426 removes transfer residual toner which remains on the surface of intermediate transfer belt 421 after a secondary transfer. A configuration (so-called belt-type secondary transfer unit) in which a secondary transfer belt is installed in a stretched state in a loop form around a plurality of support rollers including a secondary transfer roller may also be adopted in place of secondary transfer roller 424.

Fixing section 60 includes upper fixing section 60A having a fixing side member disposed on a fixing surface (the surface on which a toner image is formed) side of label roll sheet P or sheet S, lower fixing section 60B having a back side supporting member disposed on the rear surface (the surface opposite to the fixing surface) side of label roll sheet P or sheet S, and the like. The back side supporting member is brought into pressure contact with the fixing side member, whereby a fixing nip for conveying label roll sheet P or sheet S in a tightly sandwiching manner is formed.

At the fixing nip, fixing section 60 applies heat and pressure to label roll sheet P or sheet S on which a toner image has been secondary-transferred to fix the toner image on label roll sheet P or sheet S. Fixing section 60 is disposed as a unit in fixing part F. In addition, fixing part F may be provided with an air-separating unit that blows air to separate label roll sheet P or sheet S from the fixing side member or the back side supporting member.

Upper fixing section 60A includes endless fixing belt 61, heating roller 62 and fixing roller 63, which serve as a fixing side member (belt heating system). Fixing belt 61 is installed in a stretched state around heating roller 62 and fixing roller 63 with a predetermined belt tensile force (for example, 40 [N]).

Regarding fixing belt 61, for example, a PI (polyimide) having a thickness of 80 [μm] is used as a base, and the outer peripheral surface of the base is covered with a heat-resistant silicon rubber (JIS-A hardness: 30°) having a thickness of 250 [μm] as an elastic layer. Further, the surface layer has a coating of a PFA (perfluoro alkoxy), which is a heat-resistant resin, having a thickness of 70 [μm]. Fixing belt 61 has an outer diameter of 100 [mm] for example. Fixing belt 61 makes contact with label roll sheet P or sheet S on which a toner image is formed, and thermally fixes the toner image on label roll sheet P or sheet S at a fixation temperature (for example, 160 to 200[° C.]). The fixing temperature is a temperature at which a heat energy required for melting the toner on label roll sheet P or sheet S can be obtained, and the fixing temperature differs depending on factors such as the type of label roll sheet P or sheet S on which an image is to be formed.

Heating roller 62 incorporates a heating source (halogen heater) and applies heat to fixing belt 61. The heating source applies heat to heating roller 62, and as a result, fixing belt 61 is heated. The temperature of the heating source is controlled by control section 101 such that the temperature of fixing belt 61 is 180[° C.] which is a setting temperature. Heating roller 62 has an outer diameter of 50 [mm], for example.

Fixing roller 63 has a structure in which an elastic layer (thickness: 10 mm, for example) made of silicone rubber or the like and a surface layer (thickness: 70 mm, for example) made of a fluorine resin such as a PTFE resin are sequentially stacked on the outer peripheral surface of a cylindrical mandrel made of aluminum or the like, for example. Fixing roller 63 has an outer diameter of 40 [mm] for example. Fixing roller 63 is driven and controlled (for example, turn on/off of rotation, circumferential velocity, and the like) by control section 101. Control section 101 rotates fixing roller 63 in the clockwise direction. When fixing roller 63 rotates, fixing belt 61 and heating roller 62 rotate in the clockwise direction to follow the rotation of fixing roller 63.

Lower fixing section 60B includes pressure roller 64 serving as a back side supporting member (roller pressing type). Pressure roller 64 has a structure in which an elastic layer made of silicone rubber or the like and a surface layer composed of a PFA-tube are sequentially formed on the outer peripheral surface of a cylindrical mandrel made of iron or the like, for example. Pressure roller 64 has an outer diameter of 40 [mm] for example. Pressure roller 64 is brought into pressure contact with fixing roller 63 with fixing belt 61 therebetween with a predetermined fixing load (for example, 1000 [N]) by a pressure contact separation section (not illustrated). The pressure contact separation section has a conventional configuration, and brings fixing belt 61 and pressure roller 64 into pressure contact with each other or separates fixing belt 61 and pressure roller 64 from each other. Thus, a fixing nip for conveying label roll sheet P or sheet S in a tightly sandwiching manner is formed between fixing belt 61 and pressure roller 64. Pressure roller 64 and the pressure contact separation section are driven and controlled (for example, on/off of rotation, circumferential velocity, and the like) by control section 101. Control section 101 rotates pressure roller 64 in the counterclockwise direction.

Sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated on the basis of the basis weight, the size, and the like, for each type set in advance. Conveyance path section 53 has a plurality of pairs of conveyance rollers including a pair of registration rollers 53*a*. A registration roller section in which registration roller pair 53*a* is arranged corrects skew and displacement of sheet S or label roll sheet P.

Sheets S stored in sheet tray units 51*a* to 51*c* are output one by one from the uppermost, and conveyed to image forming section 40 through conveyance path section 53. In image forming section 40, the toner image on intermediate transfer belt 421 is secondary-transferred to one side of sheet S at one time, and a fixing process is performed in fixing section 60. In addition, label roll sheet P fed from sheet feeding apparatus 1 to image forming apparatus 2 is conveyed to image forming section 40 through conveyance path section 53. Then, in image forming section 40, the toner image on intermediate transfer belt 421 is secondary-transferred to one side of label roll sheet P at one time, and a fixing process is performed in fixing section 60. Label roll sheet P or sheet S on which an image has been formed is conveyed to winding apparatus 3 by sheet ejection section 52 having conveyance roller pair (sheet ejection roller pair) 52*a*.

Winding apparatus 3 is an apparatus for winding up and housing label roll sheet P conveyed from image forming apparatus 2. As illustrated in FIG. 1, in the housing of winding apparatus 3, label roll sheet P is wound around a support shaft and held in a roll shape for example. As such, winding apparatus 3 winds up label roll sheet P which is conveyed from image forming apparatus 2 via a plurality of conveyance roller pairs (for example, delivery rollers and sheet ejection rollers) around the support shaft at a constant speed. The winding operation of winding apparatus 3 is controlled by control section 101 of image forming apparatus 2.

In this manner, label roll sheet P fed from sheet feeding apparatus 1 to image forming apparatus 2 is conveyed to image forming section 40 through conveyance path section 53. Then, in image forming section 40, a toner image is transferred onto one surface of label roll sheet P at one time, and thereafter, a fixation process is performed in fixing section 60. In addition, label roll sheet P stored in sheet feeding section 51 is conveyed to image forming section 40 through conveyance path section 53. Then, in image forming section 40, a toner image is transferred onto one surface of label roll sheet P at one time, and thereafter, a fixation process is performed in fixing section 60.

In image forming apparatus 2, a pressure is exerted on label roll sheet P from the secondary transfer nip when a toner image is transferred to label roll sheet P, and a pressure is exerted on label roll sheet P from the fixing nip at the time of fixation after the secondary transfer. With the pressure, paste (adhesive agent) may possibly be protruded from both end portions of label roll sheet P. When the paste is protruded and is transferred and attached to the roller or the belt, the transfer cleaning section, the secondary transfer roller, and the belt may possibly be smeared, and abnormal abrasion and image defects may possibly be caused during the cleaning operation and the like.

Figure 3:
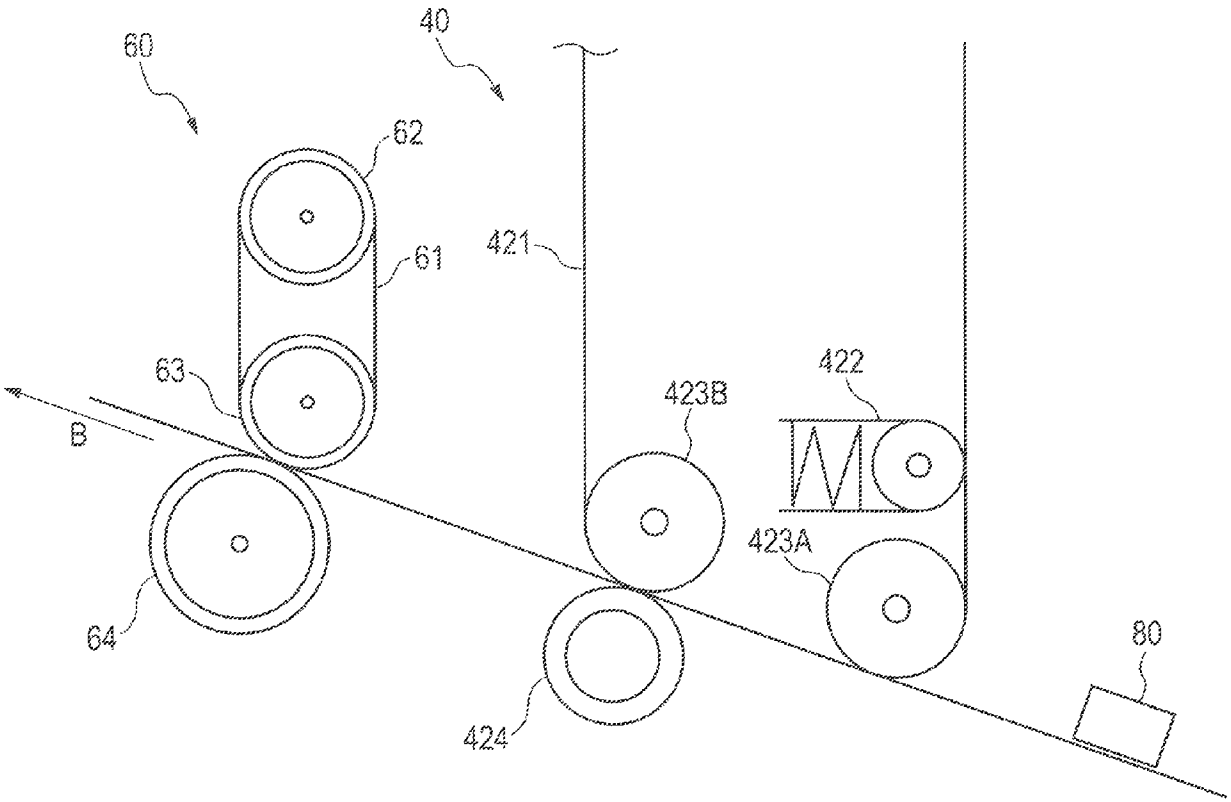
FIG. 3 illustrates an installation position of a pressing member of the image forming apparatus of FIG. 1.
Figure 4:
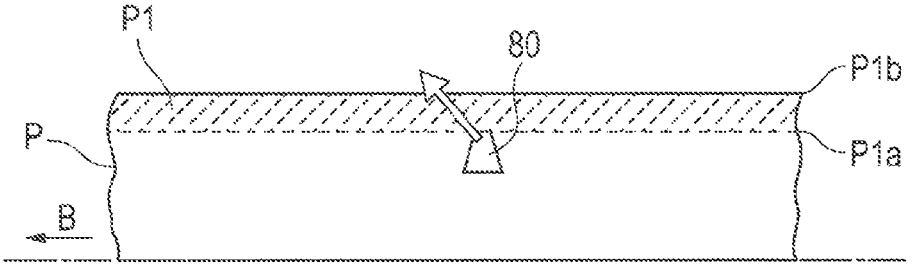
FIG. 4 is a drawing for describing an operation of the pressing member of the image forming apparatus of FIG. 1.

In view of this, image formation system 100 of the present embodiment has pressing member 80. Pressing member 80 is disposed on the upstream side relative to image forming section 40 in the conveyance direction of label roll sheet P (in FIG. 3, arrow B direction), and is configured to move from a center toward an end of label roll sheet P in the sheet width direction orthogonal to the sheet conveyance direction, and press an end portion of label roll sheet P to extrude the paste as illustrated in FIG. 3. The paste removal range at an end portion of label roll sheet P is outside the image formation region, and is about 5 mm, for example. As illustrated in FIG. 4, pressing member 80 applies pressure while moving at an acute angle to the sheet conveyance direction (hereinafter referred to simply as "oblique") in the paste removal range P1 of label roll sheet P, and extrudes the paste from outer end P1*b* of paste removal range P1 of label roll sheet P. The movement speed of pressing member 80 is equal to the sheet conveyance speed. While FIG. 4 illustrates one half of label roll sheet P, pressing member 80 also extrudes the paste in paste removal range P1 of the remaining half.

Figure 5:
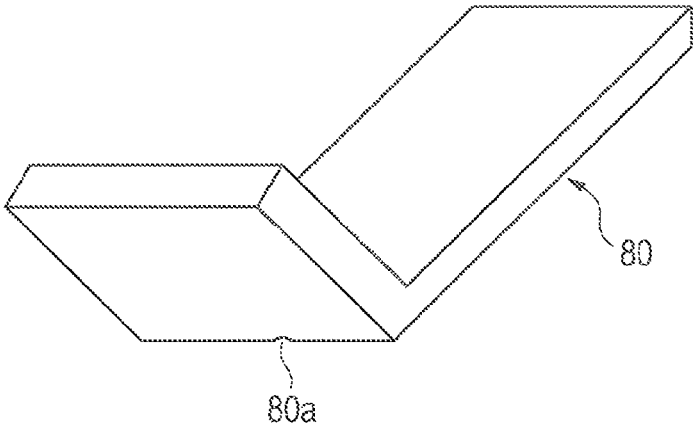
FIG. 5 is a perspective view illustrating an external appearance of the pressing member of the image forming apparatus of FIG. 1.
Figure 6:
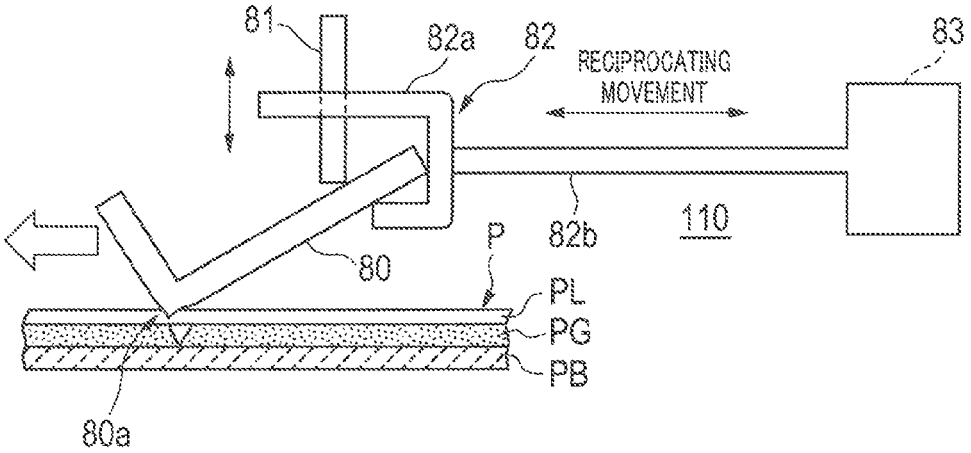
FIG. 6 illustrates a configuration of an end pressing section of the image forming apparatus of FIG. 1.

FIG. 5 is a perspective view illustrating an external appearance of pressing member 80. FIG. 6 illustrates a configuration of end pressing section 110. End pressing section 110 includes, in addition to pressing member 80, auxiliary pressing member 81 configured to press pressing member 80, supporting member 82 configured to support pressing member 80 and auxiliary pressing member 81, and driving section 83 configured to move pressing member 80 with respect to label roll sheet P. FIG. 6 also illustrates a cross-section of label roll sheet P. Label roll sheet P has a 3-layer structure of base material PL, paste PG and release sheet PB, and paste PG is provided between base material PL and release sheet PB.

Figure 8:
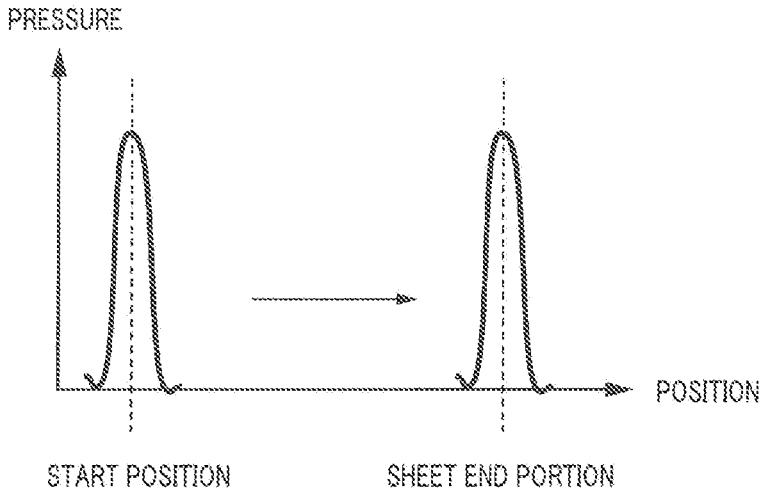
FIG. 8 shows a timing at which a pressure is exerted on the pressing member of the image forming apparatus of FIG. 1 in the paste removal range.

As illustrated in FIG. 5, pressing member 80 is composed of an L-shaped plate made of a metal material such as stainless-steel. As illustrated in FIG. 6, pressing member 80 is supported by supporting member 82 such that corner portion 80*a* makes contact with label roll sheet P. Auxiliary pressing member 81 is configured to exert a pressure on pressing member 80, and is composed of a plurality of laminated piezoelectric elements (not illustrated), for example. By applying a voltage to each piezoelectric element, pressure adjustment of multiple levels can be achieved. In the present embodiment, the position where corner portion 80*a* of pressing member 80 makes contact with label roll sheet P is set as a peak position, and the pressure exerted on pressing member 80 is adjusted such that the pressure at the peak position is approximately 10 N/m. In addition, as illustrated in FIG. 8, the timing at which the pressure is exerted on pressing member 80 is set at a start position where extrusion of paste PG is started, and a sheet end portion where extrusion of paste PG is completed. In this case, the position where extrusion of paste PG is started is the position of center side end P1*a* of paste removal range P1 of label roll sheet P, and the position where extrusion of paste PG is completed is the position of outer end P1*b* of paste removal range P1 of label roll sheet P. It is to be noted that an electromagnet may be used in place of the piezoelectric element.

In FIG. 6, supporting member 82 includes supporting section 82*a* formed in a substantially U-shape in cross-section, and coupling part 82*b* that couples supporting section 82*a* and driving section 83. Supporting section 82*a* supports pressing member 80 together with auxiliary pressing member 81. In this case, pressing member 80 is supported such that the orientation of pressing member 80 is oblique to the sheet conveyance direction. Driving section 83 operates such that pressing member 80 reciprocates between the center side end P1*a* and outer end P1*b* in paste removal range P1 of label roll sheet P. Driving section 83 is composed of a motor and a cam mechanism that converts the rotational movement of the motor to a linear movement which are not illustrated in the drawings, and the like. Driving section 83 is controlled by control section 101.

Figure 7A:
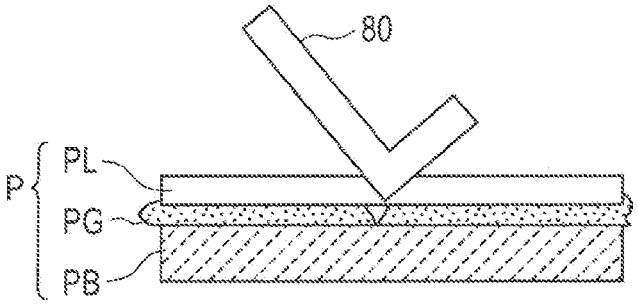
FIG. 7A illustrates a state where a pressure is temporarily exerted on the pressing member at a center side end position of a paste removal range of a label roll sheet in the case where paste is extruded from the paste removal range of the label roll sheet by the pressing member of the image forming apparatus of FIG. 1.
Figure 7B:
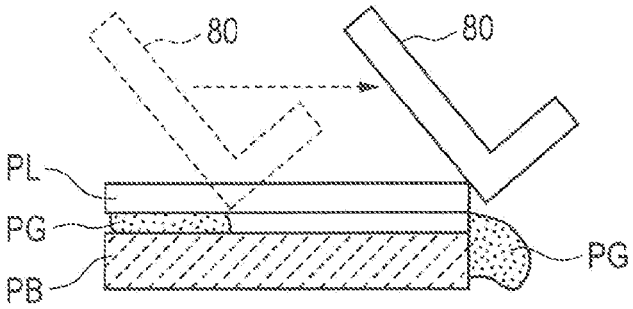
FIG. 7B illustrates a state where the pressing member starts to move from a center side end toward an outer end of the paste removal range of the label roll sheet in the case where paste is extruded from the paste removal range of the label roll sheet by the pressing member of the image forming apparatus of FIG. 1.
Figure 7C:
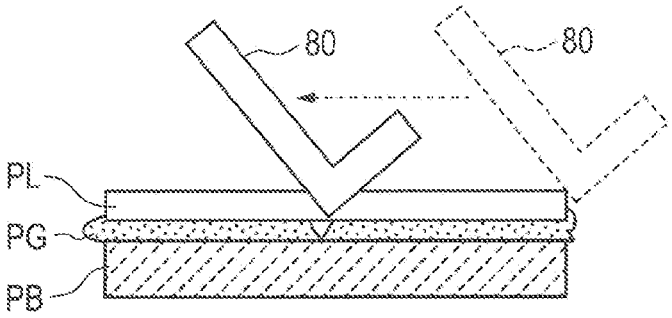
FIG. 7C illustrates a state where the pressing member starts to move from an outer end toward a center side end of the paste removal range of the label roll sheet in the case where paste is extruded from the paste removal range of the label roll sheet by the pressing member of the image forming apparatus of FIG. 1.

FIGS. 7A to 7C illustrate an operation of extruding paste PG in paste removal range P1 of label roll sheet P. As illustrated in FIG. 7A, a pressure is temporarily exerted on pressing member 80 at the position of the center side end P1*a* of paste removal range P1 of label roll sheet P (start position). When a pressure is exerted on pressing member 80, corner portion 80*a* of pressing member 80 reaches the layer of paste PG of label roll sheet P, and at the position where pressing member 80 reaches, the layer of paste PG is divided. After the layer of paste PG is divided, pressing member 80 starts to move from the center side end P1 toward outer end P1*b* of paste removal range P1 of label roll sheet P as illustrated in FIG. 7B. Along with the movement of pressing member 80, divided paste PG is moved to outer end P1*b* of paste removal range P1 of label roll sheet P. Then, when pressing member 80 reaches outer end P1*b* of paste removal range P1 of label roll sheet P, a pressure is temporarily exerted on pressing member 80 at outer end P1*b*. When a pressure is exerted on pressing member 80, the tail end of divided paste PG is cut out from outer end P1*b* of paste removal range P1 of label roll sheet P. Thereafter, as illustrated in FIG. 7C, pressing member 80 starts to move from outer end P1*b* toward center side end P1*a* of paste removal range P1 of label roll sheet P. The above-mentioned operation is repeatedly performed during conveyance of label roll sheet P.

The present embodiment includes pressing member 80 disposed on the upstream side of image forming section 40 in the conveyance direction of label roll sheet P, and configured to move from a center toward an end of label roll sheet P in the sheet width direction orthogonal to the sheet conveyance direction and press an end portion of label roll sheet P to extrude the paste, and pressing member 80 applies pressure while moving in a direction oblique to the sheet conveyance direction in paste removal range P1 of label roll sheet P, whereby paste PG contained in paste removal range P1 of label roll sheet P can be sufficiently extruded. Accordingly, since the paste is not exuded even when pressure is exerted on label roll sheet P during secondary transfer and fixation, the transfer cleaning section, the secondary transfer roller, and the belt are not smeared, and abnormal abrasion and image defects are not caused during the cleaning operation and the like.

Figure 9:
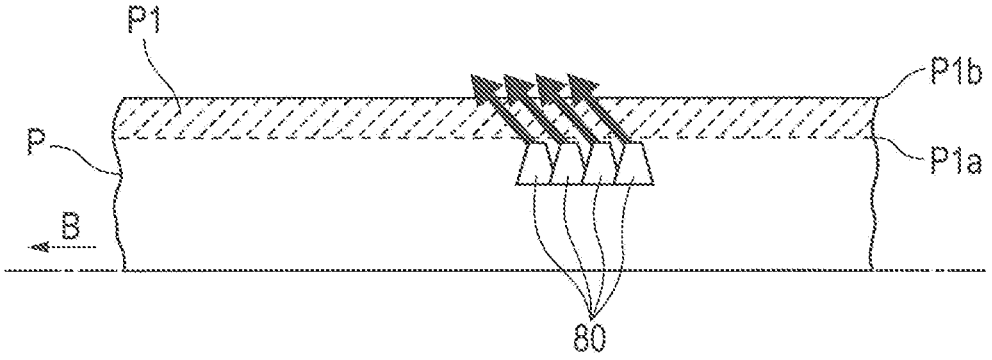
FIG. 9 illustrates an exemplary case where four pressing members are provided in the image forming apparatus of FIG. 1.

While one pressing member 80 is provided each end portion of label roll sheet P in the above-mentioned embodiment, the number of pressing member 80 is not limited to this, and a plurality of pressing members 80 may be provided. FIG. 9 illustrates an exemplary case where four pressing members 80 are provided. Each pressing member 80 is disposed in a direction oblique to the sheet conveyance direction. When a plurality of pressing members 80 are provided, the extruding amount of paste PG per unit time can be increased.

Figure 10:
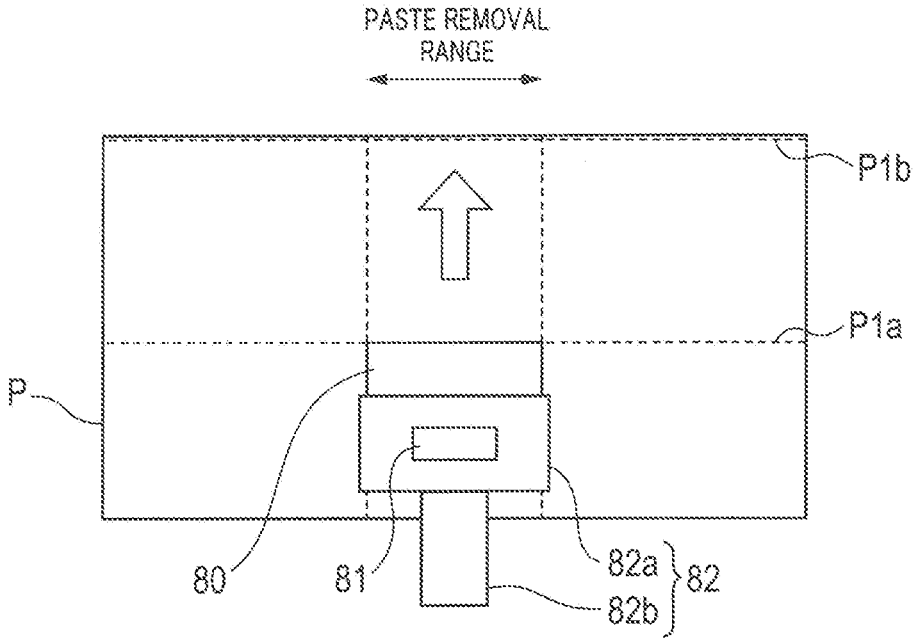
FIG. 10 illustrates an exemplary case where the pressing member of the image forming apparatus of FIG. 1 is moved at a right angle to a sheet conveyance direction of the label roll sheet.

In addition, while pressing member 80 is moved in a direction oblique to the sheet conveyance direction in the above-mentioned embodiment, pressing member 80 may be moved at a right angle to the conveyance direction of label roll sheet P as illustrated in FIG. 10. It should be noted that pressing member 80 may be moved at a right angle to the conveyance direction of label roll sheet P when the conveyance of label roll sheet P is stopped; however, since label roll sheet P is normally being conveyed, it is desirable to move label roll sheet P in a direction oblique to the conveyance direction.

In addition, while pressing member 80 has a plate-shape in the above-mentioned embodiment, pressing member 80 may has a rod shape. In this case, pressing member 80 desirably has an L-shape.

Figure 11:
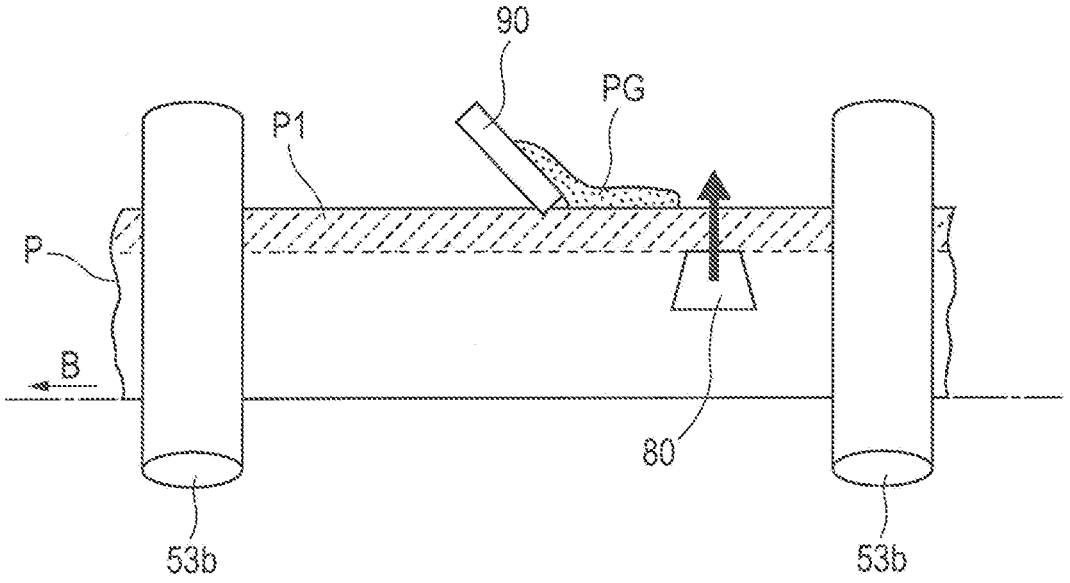
FIG. 11 illustrates an exemplary case where the image forming apparatus of FIG. 1 is provided with a scraper.

In addition, while, in the above-mentioned embodiment, paste PG is only extruded from paste removal range P1 of label roll sheet P and is not removed, the extruded paste PG may be removed. FIG. 11 illustrates an exemplary case where scraper 90 is provided. Scraper 90 is configured to remove paste PG extruded from paste removal range P1 of label roll sheet P. Scraper 90 is disposed on the downstream side of pressing member 80 in sheet conveyance direction. Paste PG extruded by pressing member 80 and attached at outer end P1*b* of paste removal range P1 of label roll sheet P is removed with scraper 90. It is to be noted that conveyance rollers 53*b* illustrated in FIG. 11 are conveyance rollers included in conveyance path section 53.

Next, modifications of pressing member 80 will be described.

[Modification 1]

Figure 12:
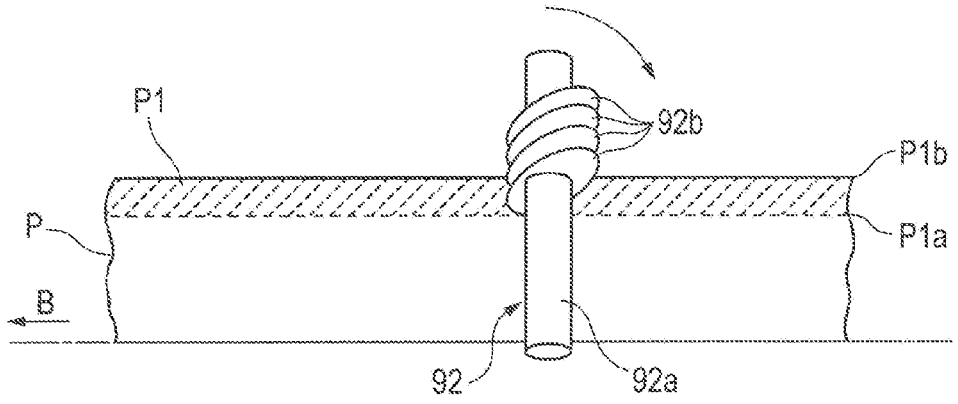
FIG. 12 illustrates Modification 1 of the pressing member of the image forming apparatus of FIG. 1.

FIG. 12 illustrates Modification 1 of pressing member 80. Pressing member 92 of Modification 1 illustrated in FIG. 12 has columnar rod 92*a* and a plurality of spiral teeth 92*b* attached on the outer peripheral surface of columnar rod 92*a* at a predetermined pitch.

Figure 13:
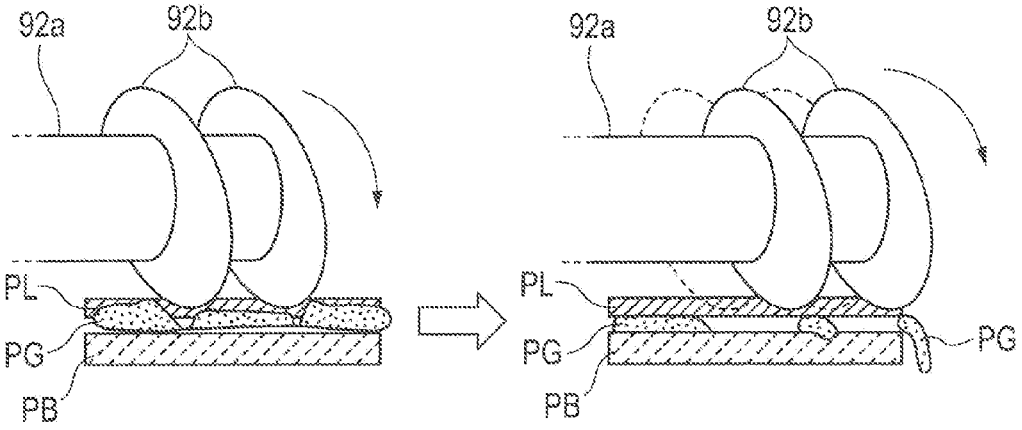
FIG. 13 illustrates a state where the pressing member of FIG. 12 extrudes paste from the paste removal range of the label roll sheet.

FIG. 13 illustrates an operation of extruding paste PG in paste removal range P1 of label roll sheet P. As illustrated in FIG. 13, pressing member 92 rotates while exerting a pressure on label roll sheet P in paste removal range P1. When each of spiral teeth 92*b* of pressing member 92 makes contact with label roll sheet P in paste removal range P1 with a predetermined pressure, each of spiral teeth 92*b* reaches the layer of paste PG of label roll sheet P, and the layer of paste PG is divided. Then, pieces of divided paste PG are extruded to outer end P1*b* of paste removal range P1 of label roll sheet P. Pressing member 92 is rotated by driving section 83 (see FIG. 2 or FIG. 6). In addition, the rotational direction of pressing member 92 is a direction in which paste PG in paste removal range P1 of label roll sheet P is extruded to outer end P1*b*. In this manner, with pressure and rotation of spiral teeth 92*b*, paste PG divided by each of spiral teeth 92*b* is extruded to outer end P1*b* of paste removal range P1 of label roll sheet P.

Figure 14:
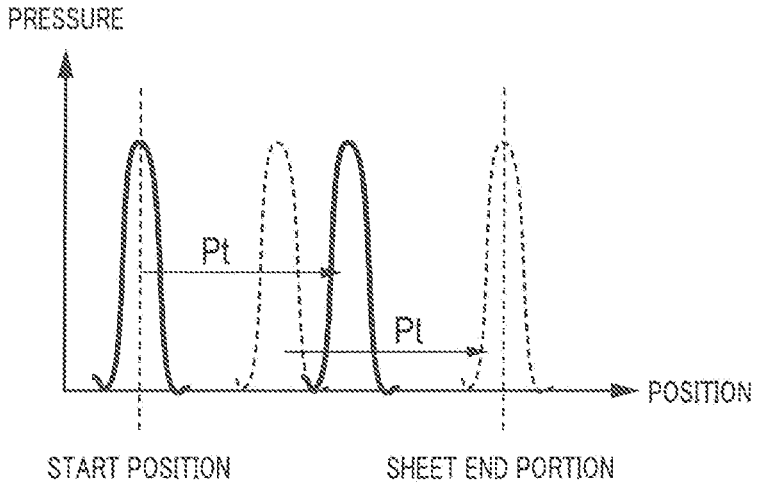
FIG. 14 shows a pressing position of spiral teeth of the pressing member of FIG. 12 on a label roll sheet in the paste removal range.

FIG. 14 illustrates pressing positions of spiral teeth 92*b* on label roll sheet P. Pressures are exerted on label roll sheet P at pitches Pt corresponding to pitches of spiral teeth 92*b*.

Figure 15:
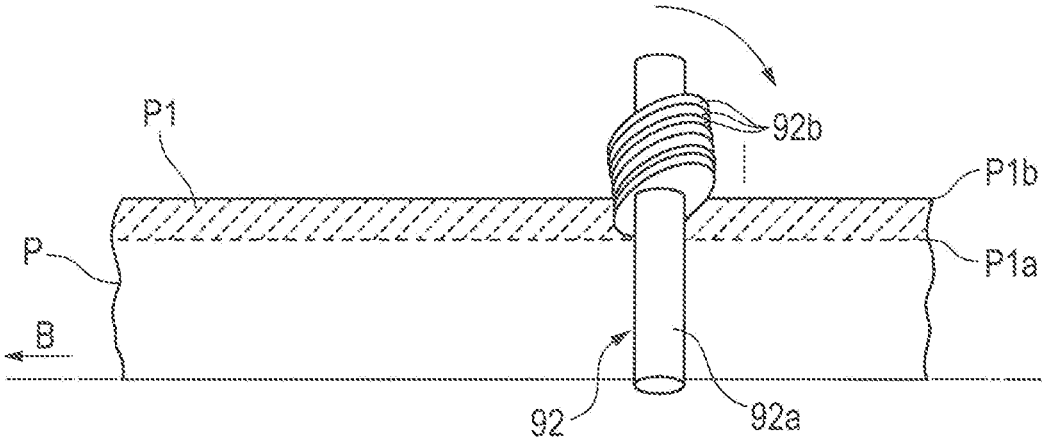
FIG. 15 illustrates an exemplary case where the number of spiral teeth of the pressing member of FIG. 12 is increased and the pitch of the teeth is decreased.

FIG. 15 illustrates an exemplary case where the number of spiral teeth 92*b* is increased and pitches Pt of the teeth is reduced. When pitch Pt of the teeth is reduced, removal of paste PG is facilitated.

In addition, paste PG extruded from label roll sheet may be removed by the above-described scraper 90.

[Modification 2]

Figure 16:
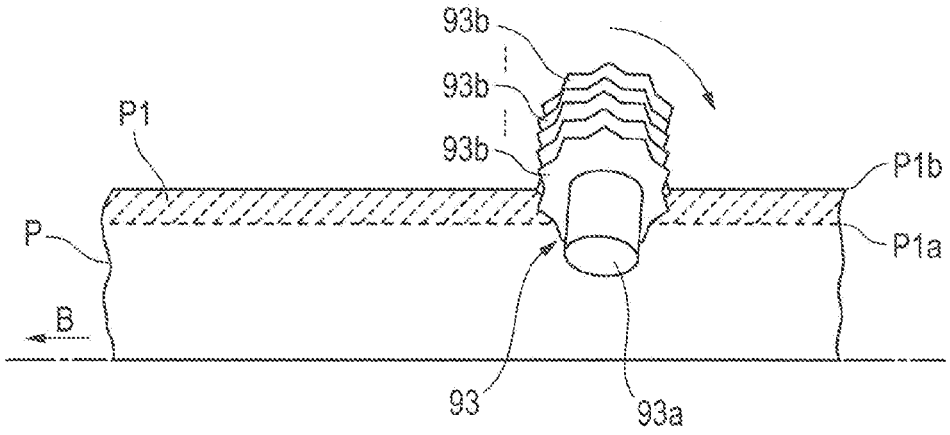
FIG. 16 illustrates Modification 2 of the pressing member of the image forming apparatus of FIG. 1.

FIG. 16 illustrates Modification 2 of pressing member 80. Pressing member 93 of Modification 2 illustrated in FIG. 16 includes columnar rod 93*a* and a plurality of gear-like disks 93*b* attached on the outer peripheral surface of columnar rod 93*a* at predetermined pitches. Gear-like disk 93*b* has a disk shape in which triangular saw-teeth are formed at predetermined pitches on the outer periphery along the circumferential direction. Since gear-like disk 93*b* has the triangular saw-teeth, the peak pressure can be increased, and the extruding force to outer end P1*b* of paste removal range P1 of label roll sheet P can be increased.

Figure 17:
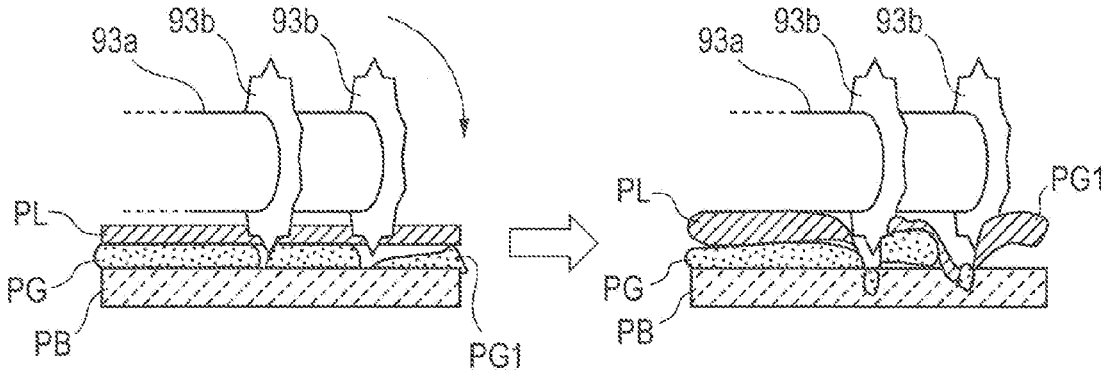
FIG. 17 illustrates a state where the pressing member of FIG. 16 extrudes paste from the paste removal range of a label roll sheet.

FIG. 17 illustrates an operation of extruding paste PG by pressing member 93 in paste removal range P1 of label roll sheet P. As illustrated in FIG. 17, pressing member 93 rotates while pressing label roll sheet P in paste removal range P1. When each of the teeth of gear-like disk 93*b* of pressing member 93 makes contact with label roll sheet P in paste removal range P1 with a predetermined pressure, the end portion of each of the teeth of gear-like disk 93*b* reaches the layer of paste PG of label roll sheet P, and the layer of paste PG is divided. Then, of pieces of divided paste PG, only paste PG at outer end P1*b* of paste removal range P1 of label roll sheet P1 is extruded to the outside, and the remaining paste PG is wrapped with base material PL. That is, base material PL and release sheet PB are attached to each other, and thus paste PG between base material PL and release sheet PB is wrapped with base material PL and release sheet PB. Pressing member 93 is rotated by rotation driving section 83 (see FIG. 2 or FIG. 6).

In this manner, in paste PG divided by each of the teeth of gear-like disk 93*b* of pressing member 93, only paste PG at outer end P1*b* of paste removal range P1 of label roll sheet P1 is extruded to the outside with pressure and rotation of gear-like disk 93*b*, and the remaining pieces of paste PG are wrapped with base material PL and release sheet PB. When paste PG is wrapped with base material PL and release sheet PB, almost no paste PG is exuded even when label roll sheet P is pressed during secondary transfer and fixation. Consequently, the possibility of occurrence of abnormal abrasion and image defects during the cleaning operation the like due to smear of the transfer cleaning section, the secondary transfer roller, and the belt is small.

Figure 18:
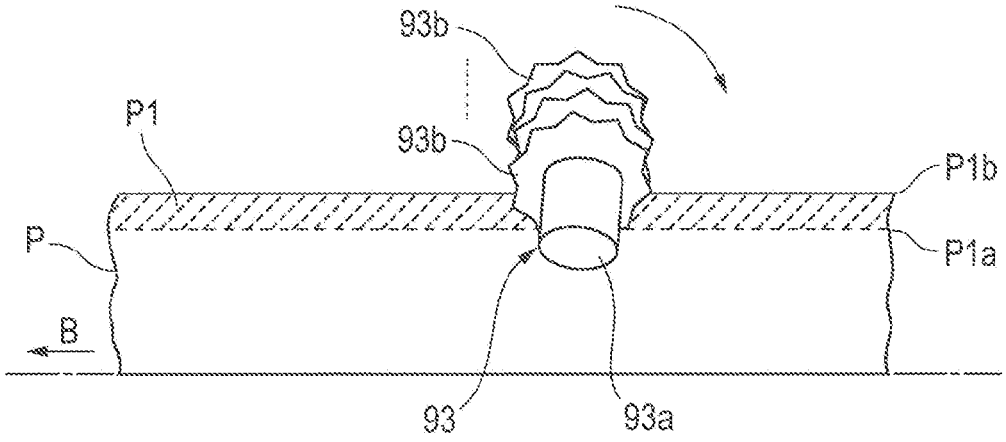
FIG. 18 illustrates a pressing member in which a gear-like disk is disposed in a spiral form.

It is to be noted that gear-like disk 93*b* of pressing member 93 of Modification 2 may be disposed in a spiral form as with Modification 1. FIG. 18 illustrates pressing member 93 in which gear-like disk 93*b* is disposed in a spiral form. When gear-like disk 93*b* is disposed in a spiral form, the pitch between gear-like disks 93*b* adjacent to each other is required to be large, and as a result the number of gear-like disks 93*b* is reduced in comparison with the exemplary case illustrated in FIG. 16.

It should be understood by those skilled in the art that various modifications, combinations, sub-combinations and alterations may occur depending on design requirements and other factors in so far as they are within the scope of the appended claims or the equivalents thereof. While the invention made by the present inventor has been specifically described based on the preferred embodiments, it is not intended to limit the present invention to the above-mentioned preferred embodiments but the present invention may be further modified within the scope and spirit of the invention defined by the appended claims.

Finally, results of an experiment for confirming the effectiveness of the present embodiment will be described.

In the experiment, in the case where label roll sheet P is conveyed using an electrophotographic process under the following common conditions, the "transition of image rank" and the "transition of paste removal amount" are compared.

The following shows results of an experiment using pressing member 80, pressing member 92 and pressing member 93 which are described in the embodiment, and a member (press roller) of a conventional technique disclosed in PTL 1.

Figure 19:
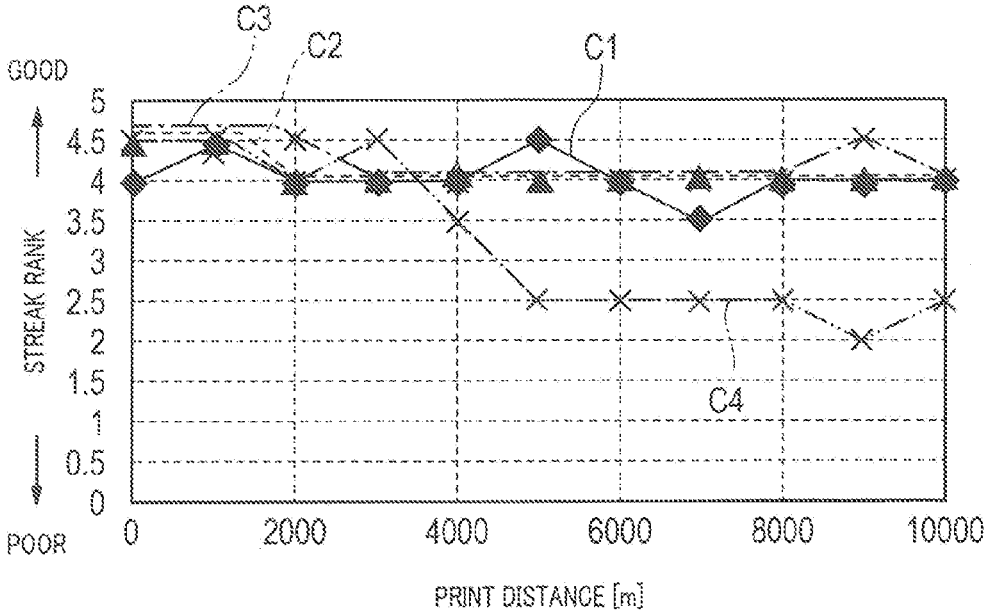
FIG. 19 shows transition of the image rank for describing the effectiveness of the embodiment.

Conditions of experiment
Environment: 25° C., 50%
Pressing position: 5 mm from an end of label roll sheet P
Pressing nip width: 10 mm
Processing speed: 150 mm/sec
Image quality: label roll sheet per 1000 m
Paste removal amount: label roll sheet per 1000 m FIG. 19 shows transition of the image rank. In FIG. 19, the abscissa indicates the print distance (m), and the ordinate indicates the streak rank. The greater the numerical value of the streak rank, the more preferable. The streak rank is expressed in values from 0 to 5 in units of 0.5. Polygonal line C1 indicates the transition of the image rank of pressing member 80, polygonal line C2 the transition of the image rank of pressing member 92, polygonal line C3 the transition of the image rank of pressing member 93, and polygonal line C4 the transition of the image rank of the member of the conventional technique. When the targeted permissible value of the streak rank is set to 3 or greater, pressing member 80, pressing member 92 and pressing member 93 achieved the targeted permissible value while the member of the conventional technique could not keep the rank of 3 or greater because of degradation of the image quality due to transfer of the paste to the transfer cleaning section.

Figure 20:
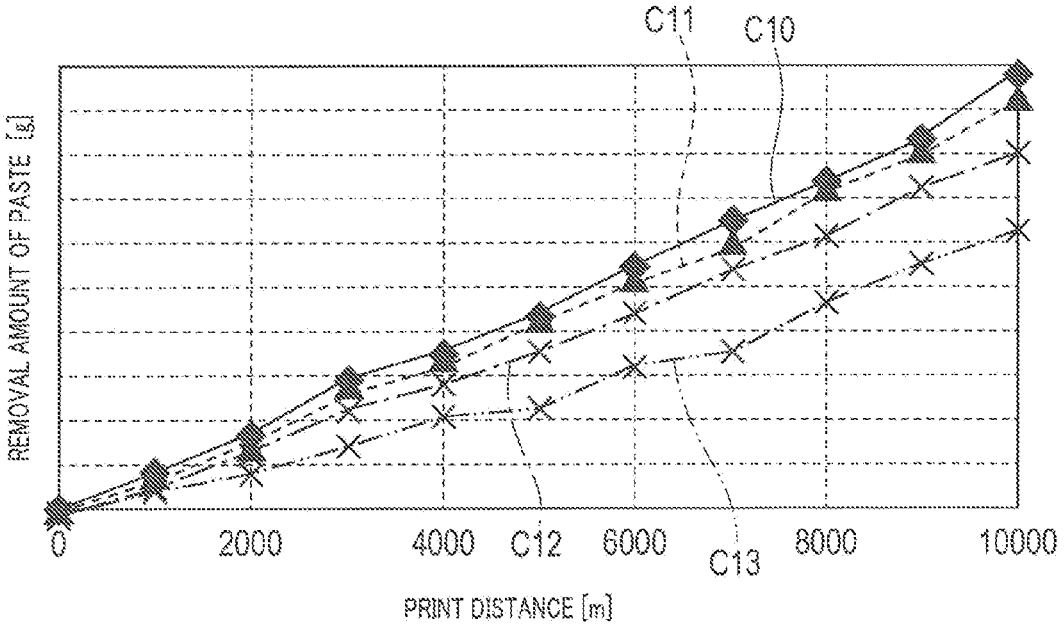
FIG. 20 shows transition of paste removal amount for describing the effectiveness of the embodiment.

FIG. 20 shows the transition of the paste removal amount. In FIG. 20, the abscissa indicates the print distance (m), and the ordinate indicates the paste removal amount (g). Polygonal line C10 indicates the transition of the paste removal amount of pressing member 80, polygonal line C11 the transition of the paste removal amount of pressing member 92, polygonal line C12 the transition of the paste removal amount of pressing member 93, and polygonal line C13 the transition of the paste removal amount of the member of the conventional technique. Paste PG extruded from outer end P1*b* of paste removal range P1 of label roll sheet P is removed by the same method (for example, a method using scraper 90), the removal amount of paste PG relative to the print distance was confirmed per 1000 m. In the case of the conventional technique, the removal amount was small from the start, and paste PG which was not completely removed was transferred to the transfer cleaning section and the like, and image defects were caused. In the case of the conventional technique, image defects were caused when the print distance reached 400 m, and in the cases of pressing member 80, pressing member 92 and pressing member 93, stable removal was achieved and image quality defects were not caused. While the removal amount of pressing member 93 was small in comparison with pressing member 80 and pressing member 92, image defects were not caused since exuding of paste PG from the center side end P1*a* of paste removal range P1 of label roll sheet P was suppressed.

REFERENCE SIGNS LIST

1 Sheet feeding apparatus
2 Image forming apparatus
3 Winding apparatus
10 Image forming section
20 Operation display section
30 Image processing section
40 Image forming section
50 Sheet conveyance section
60 Fixing section
72 Storage section
80, 92, 93 Pressing member
81 Auxiliary pressing member
82 Supporting member

83 Driving section
90 Scraper
92*a*, 93*a* Columnar rod
92*b* Spiral teeth
93*b* Gear-like disk
P Label roll sheet
PL Base material
PG Paste
PB Release sheet
P1 Paste removal range

What is claimed is:

1. An image forming apparatus comprising:

an image forming section configured to form a toner image on a sheet having a paste component; and an end pressing section provided on an upstream side of the image forming section in a sheet conveyance direction, and configured to exert a pressure on an end portion of the sheet while moving from a center toward an end of the sheet in a sheet width direction orthogonal to the sheet conveyance direction.

2. The image forming apparatus according to claim 1, wherein the end pressing section includes a plate-shaped member.

3. The image forming apparatus according to claim 2, wherein the end pressing section exerts a pressure on the end portion of the sheet while moving the plate-shaped member at a speed equal to a speed for conveying the sheet.

4. The image forming apparatus according to claim 1, wherein the end pressing section includes a spiral-shaped member.

5. The image forming apparatus according to claim 1, wherein the end pressing section includes a member in which a protrusion is formed.

6. The image forming apparatus according to claim 5, wherein, in the end pressing section, the member is disposed in a spiral form.

7. An image formation system comprising:

a sheet feeding apparatus configured to feed a label roll sheet having a paste component;

the image forming apparatus according to claim 1; and a winding apparatus configured to wind up the label roll sheet on which an image is formed by the image forming apparatus.

8. The image formation system according to claim 7, wherein the end pressing section includes a plate-shaped member.

9. The image formation system according to claim 8, wherein the end pressing section exerts a pressure on the end portion of the sheet while moving the plate-shaped member at a speed equal to a speed for conveying the sheet.

10. The image formation system according to claim 7, wherein the end pressing section includes a spiral-shaped member.

11. The image formation system according to claim 7, wherein the end pressing section includes a member in which a protrusion is formed.

12. The image formation system according to claim 11, wherein, in the end pressing section, the member is disposed in a spiral form.

13. An image formation system comprising:

a sheet feeding apparatus configured to feed a label roll sheet having a paste component;

the image forming apparatus according to claim 2; and a winding apparatus configured to wind up the label roll sheet on which an image is formed by the image forming apparatus.

14. An image formation system comprising:

a sheet feeding apparatus configured to feed a label roll sheet having a paste component;

the image forming apparatus according to claim 3; and a winding apparatus configured to wind up the label roll sheet on which an image is formed by the image forming apparatus.

15. An image formation system comprising:

a sheet feeding apparatus configured to feed a label roll sheet having a paste component;

the image forming apparatus according to claim 4; and a winding apparatus configured to wind up the label roll sheet on which an image is formed by the image forming apparatus.

16. An image formation system comprising:

a sheet feeding apparatus configured to feed a label roll sheet having a paste component;

the image forming apparatus according to claim 5; and a winding apparatus configured to wind up the label roll sheet on which an image is formed by the image forming apparatus.

17. An image formation system comprising:

a sheet feeding apparatus configured to feed a label roll sheet having a paste component;

the image forming apparatus according to claim 6; and a winding apparatus configured to wind up the label roll sheet on which an image is formed by the image forming apparatus.

* * * * *